United States Patent [19]

Hall

[11] Patent Number: 4,860,476

[45] Date of Patent: Aug. 29, 1989

[54] AUTOMOBILE DISPLAY DEVICE

[75] Inventor: Tony R. Hall, Naranja, Fla.

[73] Assignee: Lite Works, Inc., Naranja, Fla.

[21] Appl. No.: 94,689

[22] Filed: Sep. 9, 1987

[51] Int. Cl.[4] ..... G09F 21/04

[52] U.S. Cl. ..... 40/593; 40/591; 40/597; 40/547

[58] Field of Search ..... 40/591, 547, 579, 597, 40/593

[56] References Cited

U.S. PATENT DOCUMENTS

| | | | |
|---|---|---|---|
| 1,610,447 | 12/1926 | Humphrey | 40/591 |
| 1,856,519 | 5/1932 | Spears | 40/597 |
| 1,879,057 | 9/1932 | Bray | 40/579 |
| 1,894,857 | 1/1933 | Dwyer et al. | 40/591 |
| 3,530,615 | 9/1970 | Meyer | 40/547 |
| 4,264,979 | 4/1981 | Gutowski | 40/593 X |
| 4,276,705 | 7/1981 | Barth et al. | 40/579 |

FOREIGN PATENT DOCUMENTS

| | | | |
|---|---|---|---|
| 2639682 | 9/1978 | Fed. Rep. of Germany | 40/579 |
| 1565582 | 3/1969 | France | 40/579 |
| 2037471 | 7/1980 | United Kingdom | 40/579 |
| 2173028 | 10/1986 | United Kingdom | 40/591 |

*Primary Examiner*—Gene Mancene
*Assistant Examiner*—J. Hakomaki
*Attorney, Agent, or Firm*—Hedman, Gibson, Costigan & Hoare

[57] ABSTRACT

An internally illuminated message display apparatus for an automobile. The apparatus comprises a housing, a perforated display board, and a plurality of light transmitting indicia elements insertable into the display board perforations. A transparent lens is positioned in front of the display board and its indicia elements, and the housing is provided with a reflective back surface.

6 Claims, 2 Drawing Sheets

AUTOMOBILE DISPLAY DEVICE

FIELD OF THE INVENTION

The invention relates to a system and apparatus for displaying messages. More particularly, the invention relates to an apparatus for displaying messages from the rear window of an automobile.

BACKGROUND OF THE INVENTION

For some time signs have been available to hang or mount on automobiles to display messages to people outside the automobile. A current fad is to hang a sign on the rear window that makes a statement about the occupant or occupants in the automobile. Typically, the signs are two-dimensional diamond shaped boards with black letters on a yellow background and are suspended from the window glass by a suction member.

Previously, illuminated signs have been suspended from various locations on an automobile. For example, lamps have been mounted externally on an automible in a simulated spare tire made of transparent plastic with a message in opaque lettering appearing on the transparent plastic. In addition, permanent signs have been formed into automobile structures which can be seen when illuminated and which can be obscured when the illumination light is out.

SUMMARY OF THE INVENTION

It is an object of this invention to provide a sign apparatus that facilitates the use of various signs selectively.

It is another object of the invention to provide an automobile sign that affords clear and colorful messages that can be seen in day and night.

It is a further object of the invention to provide an electrically energized display sign for an automobile or window that can be selectively energized.

As a result, a display apparatus formed of a housing and display board assembly is provided. The display board assembly has front and back reflective surfaces and provisions for insertion of pin lights to form letters that spell a message. An illumination system of lamps within the housing and an electrical conductor extending from the lamps to an electrical power source is also provided.

DESCRIPTION OF THE DRAWINGS

The invention will be better understood when viewed with the following drawings wherein.

DESCRIPTION OF THE PREFERRED EMBODIMENT

The present invention is directed to an apparatus adapted to selectively display a variety of messages in words or symbols. The apparatus includes a display member particularly well suited for mounting on the window 5 of an automobile.

Figure 1:
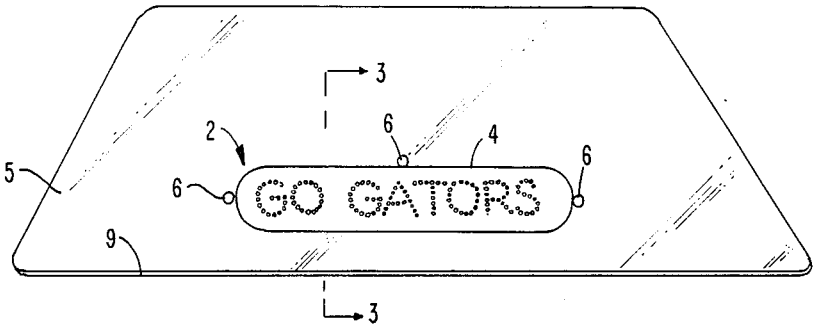
FIG. 1 is an elevational view of the invention mounted on an automobile rear window.

As best seen in FIG. 1, the display apparatus 2 is comprised of a display member assembly 4, and mounting means 6.

Figure 2:
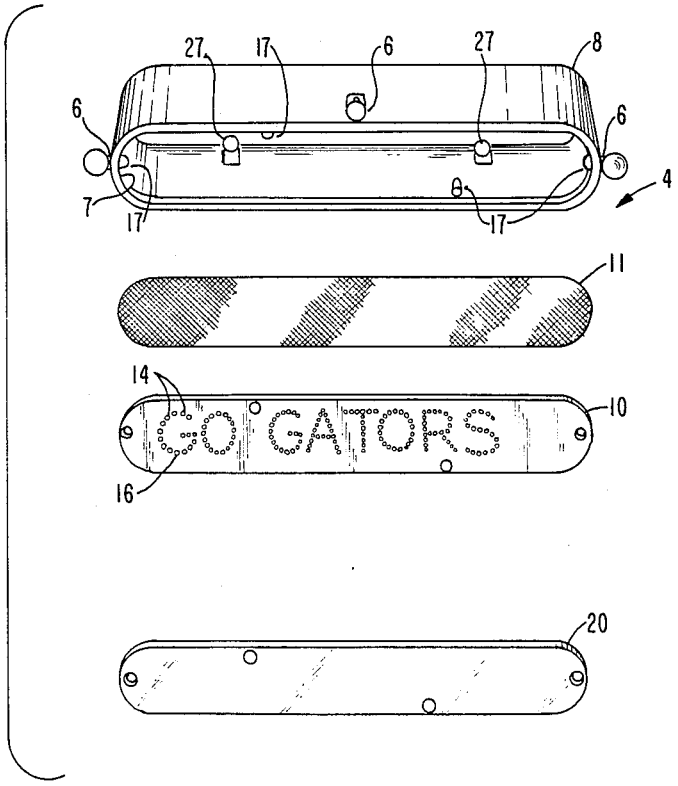
FIG. 2 is the exploded view of the display member assembly of the present invention.

The display member assembly 4 seen best in FIG. 2, is comprised of a housing 8 in which a display board 10 with backing surface 11 and a transparent lens 20 are adapted to be mounted. The display board 10 may be formed of various materials, however, practice has taught that acrylonitrile butadiene styrene (ABS) or High Impact Styrene are particularly well suited for the function of the display board. ABS and High Impact Styrene are structurally sound, opaque and easy to shape to the configuration required or a display board 10. The backing surface 11 is preferably formed of a reflective material such as MYLAR to provide reflected rather than dead light in the housing chamber.

Figure 4:
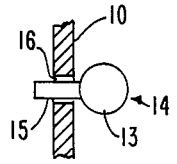
FIG. 4 is an enlarged view of the pin lights of the present invention mounted in the display board of the present invention.

The display member mechanism also includes beads 14 adapted to be inserted into individual holes 16 forming an array of 420 holes in the display board 10. The beads 14 are formed of a glass or plastic material and are commercially available as pin lights. The beads 14 are transparent and are available in nine colors. However, beads 14 of red and yellow are well suited for the practice of the invention. In particular, red pin lights 14 in combination with a gold MYLAR facing screen 12 produce a well defined illuminated message on the display board. Typically, as shown in FIG. 4, the pin lights 14 suitable for the present invention are passive pin lights, i.e. without inherent electrical illuminating capacity, and are configured with a round body 13 about 7 millimeters in diameter. The pin lights 14 are also provided with mounting members 15 extending axially from the round body 13 and being about three-sixteenths inch in diameter.

A transparent lens member 20 of GP styrene also best seen in FIG. 2, is provided to protect the assembly and provide improved illumination and resolution for the illuminated letters.

Figure 3:
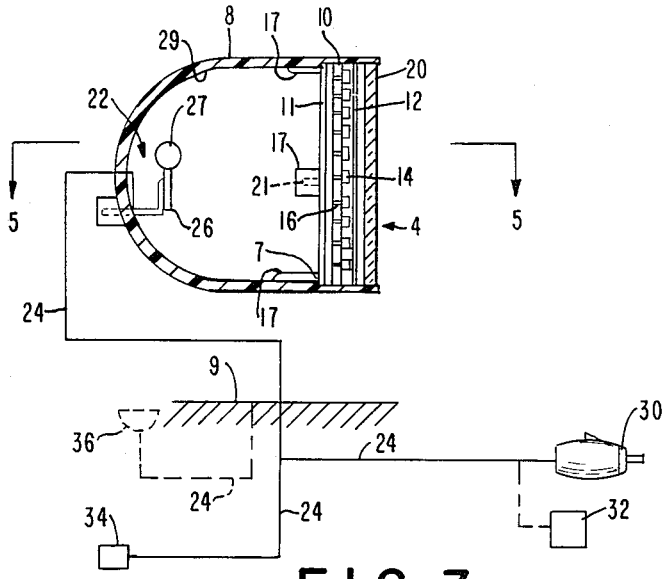
FIG. 3 is a sectional elevational view through line 3 of FIG. 1.
Figure 5:
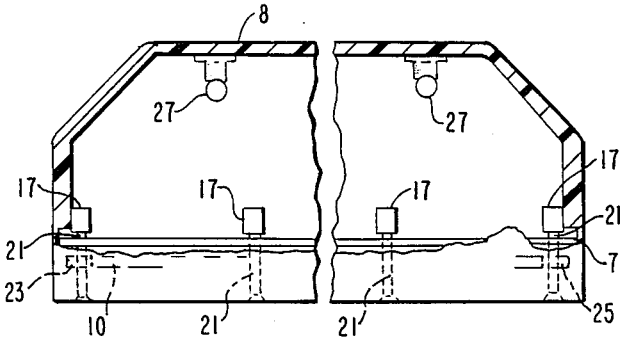
FIG. 5 is a sectional plan view through line 5—5 of FIG. 3.

An energization assembly, seen in FIG. 3, is comprised of a light source 22, conductor 24, a mount 26 for the light source 22, and termination means 30 that connect to the electrical system (cigarette lighter) of an automobile. Alternatively, the termination means 30 can connect to a battery 32 to render the system independent from the automobile electrical system. The preferred light source 22 is shown in FIG. 5 and is comprised of two instrument bulbs 27 arranged in parallel on individual mounts 26, such as bosses. Any type and grade of commercial instrument lights can serve in the embodiment, however, instrument lights identified as No. 912 instrument bulbs are well suited for service in the application.

The pin lights 14 are mounted on the display board 10 in holes 16 which are arranged to form the desired letters. Each board 10 can be provided with three-sixteenth inch diameter holes in an array to form letters; i.e. GO GATORS. It has been found that the three-sixteenth inch holes 16 should be spaced apart 0.132 inches to afford particularly suitable resolution for the illuminated letters when 7 millimeter pin lights are used.

The housing 8 is formed with a peripheral recess 7 in which the display member assembly 4 and lens 20 fit. Screw bosses 17, seen in FIGS. 3 and 5, are formed in the housing 8 to mount the display member assembly 4 and lens 20. Screws 21 pass through the holes 23 and 25 in the display board and lens 20 respectively and into the screw bosses 17 to secure the display member assembly 4 and lens 20 to the housing.

The inside surface 29 of the housing is silvered with chrome aluminum metallic spray paint to provide enhanced reflective properties to the apparatus.

Each time a different message is desired to be displayed a display member assembly 4 is mounted in the housing 8 by removal and replacement of the screws 21. The mount for the housing 8 is provided with adjustable thumb screws and suction cups that allow easy removal of the housing 8 away from the rear window where access to the screws 21 is provided. Disassembly of the apparatus and reassembly with a different display board occurs when the housing is removed from the rear window.

A display member assembly 4 is constructed by first taping the reflective backing surface 11 to the display board 10. Next the pin lights are inserted into the holes 16 in the display board 10. The lens 20 and display member assembly 4 in the housing 8 are removed. The newly formed display member assembly 4 is inserted with the edge resting on the peripheral recess 7 of the housing 8. The lens 20 is placed over the display member assembly 4 and abuts against the pin lights 14 as seen in FIG. 5. The screws 21 are inserted through the lens 20 and display member assembly 4 and into the screw bosses 17.

As seen in FIG. 3, the termination 30 for the electrical circuit is designed to plug into the cigarette lighter of an automobile. A conventional plug termination is provided. The conductor 24 runs from the termination 30 to the housing 8 and is designed to be fitted under existing carpeting to prevent interference with movement of the passengers in the automobile.

Alternatively, the conductor 24 can be connected to the tail light 34 and energized when the tail lights are energized or can be connected to the automobile overhead light 36 and be selectively engaged when the overhead light is energized.

It has been found that the resolution of the letters forming the message is particularly good when the lens 20 is placed in abutment with the rear window 5 or as close as possible to the rear window 5.

Figure 6:
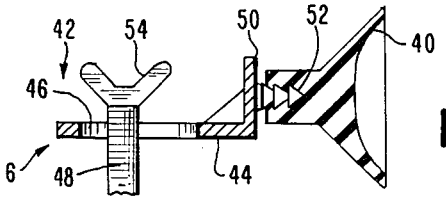
FIG. 6 is an elevational view of the mounting bracket of which there are three.

As best seen in FIG. 6, the mounting means 6 is comprised of a plurality of suction cups 40 mounted on supports 42 extending from the side of the housing. The support 42 is comprised of an adjustable bracket 44 having an axial rectangular opening 46 that fits on a mounting stud 48 extending from the housing 8. The bracket is formed with a right angle section 50 that supports a serrated barb 52 on which the suction cup 40 mounts. A thumbscrew 54 is threaded on the stud 48 to hold the composite bracket and suction cup assembly on the stud 48.

I claim:

1. A message display apparatus for an automobile window comprising:

(a) a display member assembly comprised of a housing, said housing having a display board, array of holes, a reflective back and passive pin lights in each hole of the array of holes;

(b) a transparent lens located in front of the display board;

(c) a peripheral recess formed around the front of the housing to accommodate the display member assembly and transparent lens; screw bosses behind the peripheral recess and screws adapted to pass through the display member assembly and lens to hold the display member and lens in the peripheral recess;

(d) means for mounting the housing and display member assembly adjacent to an automobile window; and (e) means for illuminating the display member assembly.

2. A message display apparatus as in claim 1 further comprising a silvered inner surface in the housing to enhance illumination of the display member assembly.

3. A message display apparatus as in claim 1 wherein the means for mounting the housing and display member assembly are comprised of adjustable mounting brackets and suction cups on the mounting brackets arranged to bear against an automobile window surface.

4. A message display apparatus as in claim 3 wherein the means for mounting the housing and display member assembly is located on the rear window to position the transparent lens against the inside surface of the automobile rear window.

5. A message display apparatus as in claim 4 wherein the means for illuminating the display member is comprised of a light source located within the housing and conductor means extending from the light source to an electrical power circuit of an automobile.

6. A message display apparatus as in claim 4 wherein the array of holes formed in the display board are three-sixteenth inch in diameter apart 0.132 inches when the pin are seven millimeter diameter pin lights.

* * * * *